US005629711A

United States Patent [19]

Matsuoka et al.

[11] Patent Number: 5,629,711

[45] Date of Patent: May 13, 1997

[54] WINDOW GLASS ANTENNA DEVICE

[75] Inventors: Yoshinori Matsuoka; Harunori Murakami, both of Osaka, Japan

[73] Assignee: Nippon Sheet Glass Co., Ltd., Japan

[21] Appl. No.: 570,077

[22] Filed: Dec. 11, 1995

Related U.S. Application Data

[63] Continuation of Ser. No. 100,930, Aug. 3, 1993, abandoned.

[30] Foreign Application Priority Data

Aug. 3, 1992 [JP] Japan ..... 4-059949 U
Nov. 12, 1992 [JP] Japan ..... 4-327371

[51] Int. Cl.[6] ..... H01Q 1/32
[52] U.S. Cl. ..... 343/704; 343/713
[58] Field of Search ..... 343/704, 713; H01Q 1/32

[56] References Cited

U.S. PATENT DOCUMENTS

| | | | |
|---|---|---|---|
| 4,914,446 | 4/1990 | Lindenmeier et al. | 343/704 |
| 5,231,410 | 7/1993 | Murakami et al. | 343/713 |
| 5,239,302 | 8/1993 | Maeda et al. | 343/704 |

*Primary Examiner*—Hoanganh T. Le
*Attorney, Agent, or Firm*—Merchant, Gould, Smith, Edell, Welter & Schmidt

[57] ABSTRACT

A window glass antenna device defrosting heaters for use as part of a reception antenna on an automobile window glass panel. The defrosting heaters include at least first and second heaters each comprising a plurality of heater wires disposed on the window glass panel, a first bus bar interconnecting ends of the heater wires, and a second bus bar interconnecting opposite ends of the heater wires. A first choke coil is connected between the first bus bars of the first and second heaters and a battery, and disposed near the first bus bars, and a second choke coil is connected between the second bus bars of the first and second heaters and the battery, and disposed near the second bus bars. The first choke coil has at least two windings disposed around a core, the windings being connected respectively to the first bus bars of the first and second heaters such that magnetic fluxes generated in the core by a first electric current flowing through the first heater and a second electric current flowing through the second heater will be canceled. The second choke coil has at least two windings disposed around a core, the last-mentioned windings being connected respectively to the second bus bars of the first and second heaters such that magnetic fluxes generated in the core by the first electric current flowing through the first heater and the second electric current flowing through the second heater will be canceled.

10 Claims, 9 Drawing Sheets

| | AL1 : NUMBER OF TURNS | AL2 : NUMBER OF TURNS | 1ST HEATER : NUMBER OF HETER WIRES | 2ND HEATER : NUMBER OF HEATER WIRES |
|---|---|---|---|---|
| —×— | 13 | 13 | 6 | 6 |
| —●— | 13 | 13 | 7 | 6 |
| —△— | 13 | 15 | 7 | 6 |

WINDOW GLASS ANTENNA DEVICE

This is a file wrapper continuation of application Ser. No. 08/100,930, filed Aug. 3, 1993, now abandoned.

BACKGROUND OF THE INVENTION

1. Field of the Invention

The present invention relates to a window glass antenna device which has, as a reception antenna or part of a reception antenna, defrosting heater wires disposed on a window glass panel of an automobile.

2. Description of the Prior Art

Use of defrosting heater wires on a window glass panel of an automobile as a reception antenna or part of a reception antenna requires that the heater wires be of high impedance with respect to a heater power supply or an automobile body as ground. The heater wires are therefore supplied with a heating current through a choke coil.

The choke coil tends to be large in size because the heating current is of a relatively large magnitude ranging from several amperes to several tens of amperes. In view of such a problem, it has been customary to wind choke coil windings, to be connected respectively to positive and negative terminals, on one core by way of bifilar winding, thus preventing the core from being magnetically saturated by a heating direct current, keeping the heater wires at high impedance, and reducing the size of the choke coil. However, the efforts to reduce the size of the choke coil through bifilar winding are subject to limitations because the diameter of windings cannot be reduced.

FIGS. 7(*a*), 7(*b*), and 8 of the accompanying drawings show conventional window glass antenna devices.

FIG. 7(*a*) illustrates a known single-sided feeding structure for feeding heater wires, and FIG. 7(*b*) illustrates a known double-sided feeding structure for feeding heater wires.

The window glass antenna device with the single-sided feeding structure shown in FIG. 7(*a*) has a plurality of heater wires HW disposed horizontally across a window glass panel 65 and divided into upper and lower groups. Bus bars RB1, RB2 serving as feeder terminals for supplying a heating current to the heater wires HW are positioned on the right-hand side, for example, of the window glass panel 65, and a returning bus bar BB for returning the heating current is positioned on the left-hand side of the window glass panel 65.

Since the bus bars RB1, RB2 are located on one side, i.e., the right-hand side, of the window glass panel 65, connector wires 67, 68 interconnecting the bus bars RB1, RB2 to a choke coil CH may be relatively short. However, the resistance per unit length of each of the heater wires HW has to be low in order for the heater wires HW to be supplied with a predetermined heating current under an automobile battery voltage of 12 volts, for example, because each of the heater wires HW is relatively long.

As shown in FIG. 9 of the accompanying drawings, the heater wires HW are manufactured by printing a silver paste 65*a* to a certain thickness on the window glass panel 65 as a base, drying and baking the silver paste 65*a*, plating a copper layer 65*a* on the silver paste 65*a*, and then plating a chromium layer 65*c* on the copper layer 65*a* to increase the mechanical strength of the heater on the window glass panel 65. This manufacturing process is relatively complex and entails an increase in the cost of the antenna device. The plating steps require a large investment to be made in building an installation for processing waste solutions.

The window glass antenna device with the double-sided feeding structure shown in FIG. 7(*b*) has a plurality of heater wires HW disposed horizontally across a window glass panel 75 and a pair of bus bars LB, RB disposed one on each side of the heater wires HW. The bus bars LB, RB are connected through respective connector wires 77, 78 to a choke coil CH that is positioned near the bus bar RB, for example. The choke CH is connected to a battery BAT as a heating power supply and a capacitor C for removing noise from a heating current supplied from the battery BAT. Since the choke CH is positioned near the bus bar RB, the connector wire 77 is shorter and the connector wire 78 is longer. With the connector wire 78 being longer, the coupling capacitance between the connector wire 78 and an automobile body such as a metallic window frame as ground is increased, resulting in an impedance reduction. Since the connector wires 77, 78 connected to the respective bus bars LB, RB are of different lengths, their impedances with respect to the automobile body are unbalanced. The unbalanced impedances are responsible for a reduction in the reception sensitivity of the antenna and a change in the directivity of the antenna. Inasmuch as the heater wires HW are often used as an antenna for receiving AM broadcasts, any change in the position of the connector wire 78 is undesirable as it would cause the reception sensitivity to vary.

The window glass antenna device shown in FIG. 8 corresponds to one of the typical embodiments disclosed in Japanese laid-open utility model publication No. 3-117918.

According to the disclosed window glass antennas, at least one of a pair of bus bars on both sides of a plurality of heater wires extends substantially horizontally toward the other bus bar such that signal pickup terminals of these bus bars are positioned closely to each other.

As shown in FIG. 8, the window glass antenna comprises a plurality of heater wires HW on a window glass panel 85 and two bus bars LB, RB disposed one on each side of the heater wires HW. Bus bar extensions LBE, RBE extend horizontally from the respective lower ends of the bus bars LB, RB toward the center of the window glass panel 85, and have respective distal ends P1, P2 connected to a choke coil CH. Since the ends P1, P2 or signal pickup terminals of the bus bars LB, RB are positioned clearly to each other, they can easily be connected to the choke coil CH.

If the bus bar extensions LBE, RBE are formed of electrically conductive frit without plating, then since the resistance of the bus bar extensions LBE, RBE cannot be smaller than 1 ohm per length of 10 mm and width of 1 mm, these bus bar extensions LBE, RBE develop an unwanted voltage drop and are heated when the heater wires HW are energized. Conversely, if the bus bar extensions LBE, RBE are of the structure shown in FIG. 9, then the antenna device on the window glass panel 85 is complex in structure and expensive to manufacture.

FIG. 10 of the accompanying drawings illustrates another conventional window glass antenna device.

As shown in FIG. 10, the window glass antenna device comprises a first heater 92 disposed on a window glass panel 95 and having bus bars LB1, RB1 on respective ends thereof, a second heater 93 disposed on the window glass panel 95 and having bus bars LB2, RB2 on respective ends thereof, and an antenna 94 disposed on the window glass panel 95. The first heater 92, which is composed of heater wires HW, is connected to a positive terminal of a heating power supply 98 through a first winding AL1 of a choke coil 96 and also to an automobile body as ground through a first winding BL1 of a choke coil 97. The second heater 93, which is composed of heater wires HW and whose resistance is substantially the same as the resistance of the first heater 92, is connected to the positive terminal of the heating power supply 98 through a second winding BL2 of the choke coil 97 and also to the automobile body through a second winding AL2 of the choke coil 96. The window glass antenna device is arranged such that currents through the respective first and second heaters 92, 93 cancel out magnetic fluxes generated in the cores of the choke coils 96, 97.

The numbers, lengths, and thicknesses of the heater wires HW are designed such that the resistances of the first and second heaters 92, 93 are equal to each other. However, in the mass production of the window glass antenna devices, it is difficult to equalize the resistances of the first and second heaters 92, 93 exactly with each other, and actually the resistances of the first and second heaters 92, 93 differ from each other. Consequently, currents flowing through the first and second heaters 92, 93 also differ from each other, and hence the magnetic fluxes in the cores of the choke coils 96, 97 are not canceled out due to the different currents flowing through the first and second windings of each of the choke coils 96, 97. As a result, the choke coils 96, 97 have poor inductance characteristics. FIG. 11 of the accompanying drawings shows a characteristic curve representing the relationship between the inductance of each choke coil and the difference between the currents flowing through the choke coil. It can be seen from FIG. 11 that the inductance (μH) of the choke coil greatly decreases even with a small current difference (A). The reduction in the choke inductance brings about poor antenna characteristics.

SUMMARY OF THE INVENTION

It is therefore an object of the present invention to provide a window glass antenna device of a double-sided feeding structure with heater wires and bus bars not plated, the window glass antenna device having a defrosting heater divided into a plurality of heater regions and a plurality of separate choke coils for shortening the distance over which the bus bars and the choke coils are connected, reducing the size of the choke coils, and minimizing variations in the reception sensitivity for AM broadcasts.

According to the present invention, there is provided a window glass antenna device comprising a window glass panel, defrosting heaters for use as part of a reception antenna, the defrosting heaters including at least first and second heaters each comprising a plurality of heater wires disposed on the window glass panel, a first bus bar interconnecting ends of the heater wires, and a second bus bar interconnecting opposite ends of the heater wires, current supply means for supplying electric currents to the defrosting heaters, a first choke coil connected between the first bus bars of the first and second heaters and the current supply means, and disposed near the first bus bars, and a second choke coil connected between the second bus bars of the first and second heaters and the current supply means, and disposed near the second bus bars, the first choke coil having a core and at least two windings disposed around the core, the windings being connected respectively to the first bus bars of the first and second heaters such that magnetic fluxes generated in the core by a first electric current flowing through the first heater and a second electric current flowing through the second heater will be canceled, the second choke coil having a core and at least two windings disposed around the last-mentioned core, the last-mentioned windings being connected respectively to the second bus bars of the first and second heaters such that magnetic fluxes generated in the core by the first electric current flowing through the first heater and the second electric current flowing through the second heater will be canceled.

The window glass antenna device also has an antenna disposed in capacitive coupling with one of the first and second heaters. The defrosting heaters further include a third heater disposed between the first and second heaters, the antenna including first and second patterns disposed in independent capacitive coupling with the first and second heaters, respectively.

At least one of the first and second choke coils has a third winding disposed around the core, and current adjusting means for supplying an electric current from the current supply means to the third winding for producing a magnetic flux to cancel any magnetic flux produced by the difference between electric currents flowing through the two windings.

At least one of the two windings of each of the first and second choke coils has a plurality of taps selectable to provide a number of winding turns for canceling the magnetic fluxes generated in the core by the first electric current flowing through the first heater and the second electric current flowing through the second heater will be canceled.

BRIEF DESCRIPTION OF THE DRAWINGS

FIG. 6(*b*) is a table showing the various settings for the tapped choke coils;

FIG. 7 (*b*) is a circuit diagram of a conventional window glass antenna device of a double-sided feeding structure;

DETAILED DESCRIPTION OF THE PREFERRED EMBODIMENTS

Figure 1:
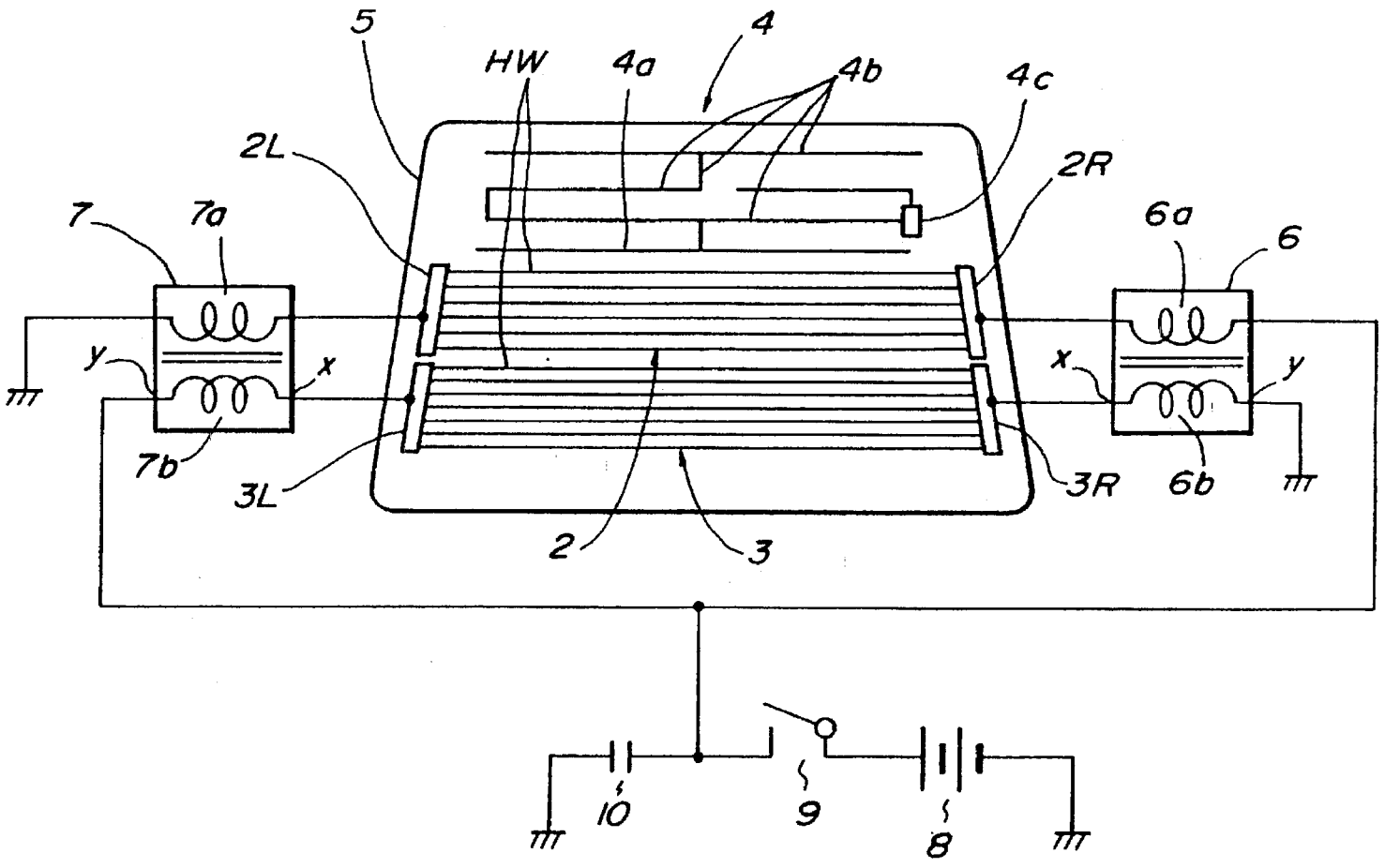
FIG. 1 is a circuit diagram of a window glass antenna device according to a first embodiment of the present invention.

Like or corresponding parts are denoted by like or corresponding reference numerals throughout views.

As shown in FIG. 1, a window glass antenna device according to a first embodiment of the present invention primarily comprises a first defrosting heater 2 disposed on a rear window glass panel 5 of an automobile, a second defrosting hearer 3 disposed on the rear window glass panel 5 downwardly of the first defrosting heater 2, an antenna 4 disposed on the rear window glass panel 5, a first choke coil 6, a second choke coil 7, a heating power supply 8, a switch 9 connected to the heating power supply 8, and a capacitor 10 connected to the switch 9 for removing noise from a current supplied from the heating power supply 8.

The first and second heaters 2, 3 have respective groups of heater wires HW extending horizontally across the window glass panel 5 substantially parallel to each other, respective bus bars 2R, 3R disposed on one side of the window glass panel 5 and interconnecting ends of the heater wires HW of the respective groups, and respective bus bars 2L, 3L disposed on the other side of the window glass panel 5 and interconnecting the other ends of the heater wires HW of the respective groups. The combined resistance of the parallel heater wires HW of the first heater 2 is substantially equal to the combined resistance of the parallel heater wires HW of the second heater 3. The heater wires HW may be in the form of defrosting wires or heating conductive films.

The window glass panel 5 is in the shape of a trapezoid with the lower side longer than the upper side. The bus bars 2R, 2L, 3R, 3L extend substantially parallel to and are spaced substantially equally from the left- and right-hand sides of the trapezoidal window glass panel 5. Therefore, the first and second heaters 2, 3 are of a trapezoidal shape with the uppermost heater wires HW of the first heater 2 serving as an upper side, the lowermost heater wire HW of the second heater 4 as a lower side, and the bus bars 2R, 3R and 2L, 3L as right- and left-hand sides. The average length of the heater wires HW of the lower second heater 2 is slightly greater than the average length of the heater wires HW of the upper first heater 3. Providing the width of each of the heater wires HW of the first heater 2 is the same as the width of each of the heater wires HW of the second heater 3, the number of heater wires HW of the second heater 3 may be greater than the chamber of heater wires HW of the first heater 2 to equalize the combined resistance of the parallel heater wires HW of the first heater 2 substantially to the combined resistance of the parallel heater wires HW of the second heater 3.

Alternatively, the number of heater wires HW of the second heater 3 may be equal to the number of heater wires HW of the first heater 2, and the width of each of the heater wires HW of the first heater 2 may be different from the width of each of the heater wires HW of the second heater 3 to equalize the combined resistance of the parallel heater wires HW of the first heater 2 substantially to the combined resistance of the parallel heater wires HW of the second heater 3.

The antenna 4, which is positioned upwardly of the first heater 2, comprises a plurality of vertical and horizontal antenna patterns 4*b* and a connected terminal 4*c* for connection to a feeder line (not shown). The antenna 4 also includes a lower antenna pattern 4*a* connected to the uppermost heater wire HW of the first heater 2 through capacitive coupling for efficiently drawing electric energy received by the heater wires HW.

The choke coil 6 comprises a pair of windings 6*a*, 6*b* disposed around a core. The winding 6*a* is connected between the bus bar 2R and the switch 9, and the winding 6*b* is connected between the bus bar 3R and ground. The choke coil 7 comprises a pair of windings 7*a*, 7*b* disposed around a core. The winding 7*a* is connected between the bus bar 2L and ground, and the winding 7*b* is connected between the bus bar 3L and the switch 9.

When the switch 9 is closed, a heating current flows from a positive terminal of the power supply 8 through the winding 6*a* and the bus bar 2R to the heater wires HW of the first heater 2, and then from the bus bar 2L through the winding 7*a* to ground, i.e., a negative terminal of the power supply 8. At the same time, the heating current also flows from the positive terminal of the power supply 8 through the winding 7*b* and the bus bar 3L to the heater wires HW of the second heater 3, and then from the bus bar 3R through the winding 6*b* to ground, i.e., the negative terminal of the power supply 8.

The windings 6*a*, 6*b*, 7*a*, 7*b* of the choke coils 6, 7 are connected respectively to the bus bars 2R, 3R, 2L, 3R such that the heating currents flowing through the first and second heaters 2, 3 cancel the magnetic fluxes generated in the cores of the choke coils 6, 7.

In FIG. 1, the heating currents flow in opposite directions through the first and second heaters 2, 3. However, the heating currents may flow in the same direction through the first and second heaters 2, 3 insofar as the currents flowing through the windings 6*a*, 6*b*, 7*a*, 7*b* of the choke coils 6, 7 prevent the choke coils 6, 7 from being magnetically saturated.

To allow the heating currents to flow in the same direction through the first and second heaters 2, 3, the window glass antenna device shown in FIG. 1 may be modified as follows: The first heater 2 remains connected to the first and second heaters 2, 3 and the heating power supply 8 in the manner shown in FIG. 1, but the second heater 3 is connected to first and second heaters 2, 3 and the heating power supply 8 in a modified fashion. More specifically, the bus bar 3R of the second heater 3 is connected to a terminal y of the winding 6*b* of the first choke coil 6, and a terminal x of the winding 6*b* is connected to the positive terminal of the heating power supply 8. The bus bar 3L is connected to a terminal y of the winding 7*b* of the second choke coil 7, and a terminal x of the winding 7*b* is connected to the negative terminal of the heating power supply 8, i.e., the automobile body. In this arrangement, the heating currents flow in the same direction through the first and second heaters 2, 3 for canceling the magnetic fluxes in the cores of the choke coils 6, 7.

Since the resistances of the first and second heaters 2, 3 are substantially the same as each other, the heating currents flowing through the windings 6*a*, 6*b*, 7*a*, 7*b* of the choke coils 6, 7 may be half the heating currents in the conventional window glass antenna devices insofar as the amount of heat generated by the first and second heaters 2, 3 is the same as that in the conventional window glass antenna devices. Consequently, the windings 6*a*, 6*b*, 7*a*, 7*b* may be reduced in diameter, and hence the choke coils 6, 7 may be reduced in size.

Inasmuch as each of the first and second defrosting heaters 2, 3 is of a double-sided feeding structure with the bus bars on horizontal opposite sides of the window glass panel 5 and the choke coils 6, 7 are positioned closely to the bus bars of the first and second heaters 2, 3 horizontally outwardly of the window glass panel 5, the coupling capacitance between the automobile body as ground and connector lines which interconnect the bus bars 2L, 2R, 3L, 3R and the choke coils 6, 7, thereby minimizing leakage of AM broadcast signals received by the first and second heaters 2, 3 to the automobile body.

Figure 2:
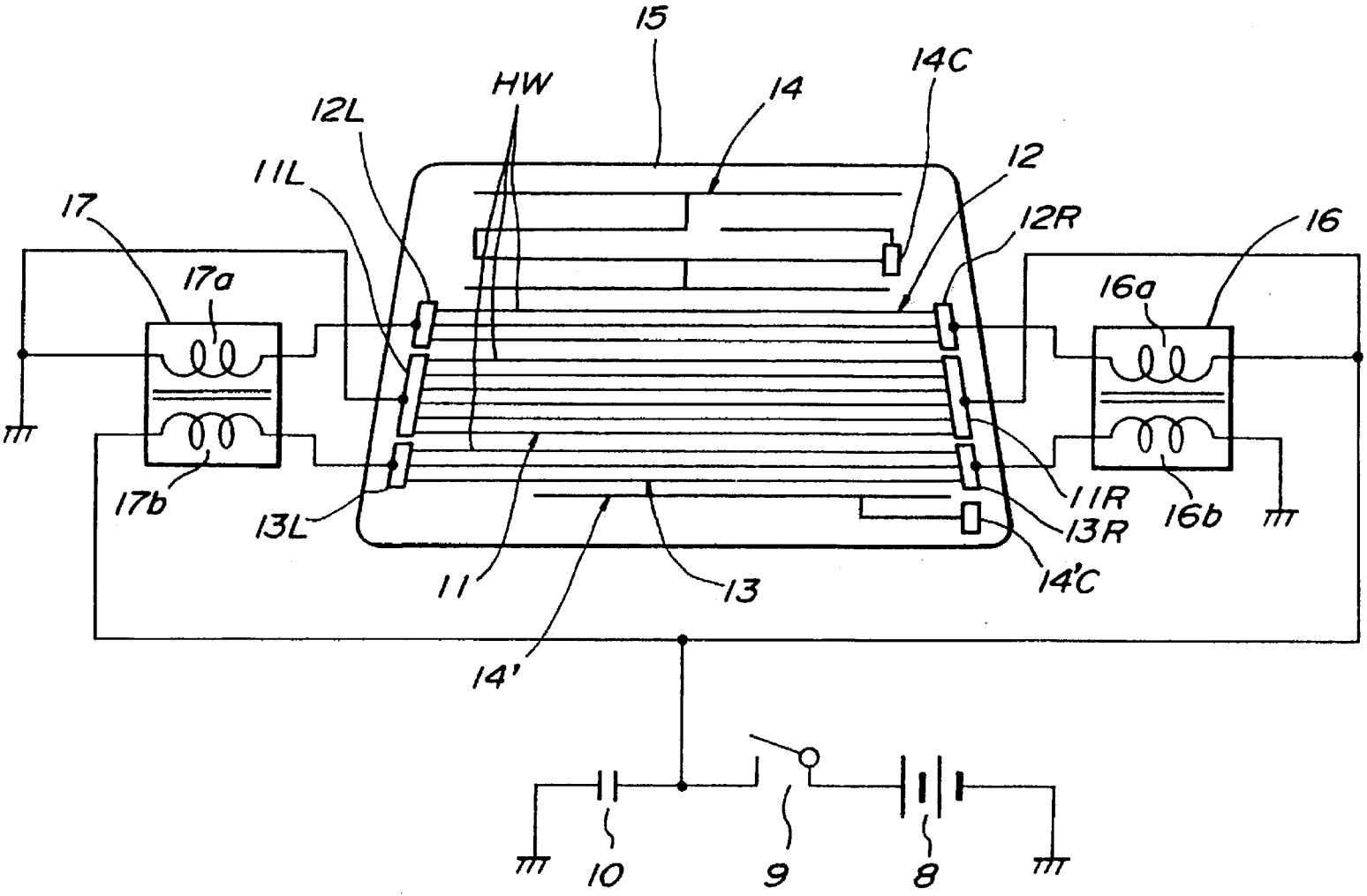
FIG. 2 is a circuit diagram of a window glass antenna device according to a second embodiment of the present invention.

FIG. 2 shows a window glass antenna device according to a second embodiment of the present invention. The window glass antenna device shown in FIG. 2 comprises three defrosting heaters 11, 12, 13, and two antennas 14, 14', all disposed on a window glass panel 15. Each of the heaters 11, 12, 13, which are also referred as middle, upper, and lower heaters, respectively, comprises a plurality of parallel heater wires HW. The window glass antenna device also has bus bars 12R, 12L connected to respective ends of the upper heater 12, bus bars 11R, 11L connected to respective ends of the middle heater 11, and bus bars 13R, 13L connected to respective ends of the lower heater 13. The combined resistance of the parallel heater wires HW of the upper heater 12 is substantially equal to the combined resistance of the parallel heater wires HW of the lower heater 13. The upper and lower heaters 12, 13 are supplied with heating currents from the heating power supply 8 through first and second choke coils 16, 17. The middle heater 11 is supplied with a heating current directly from the heating power supply 8. The first choke coil 16 has a winding 16*a* connected to the bus bar 12*a* and a winding 16*b* connected to the bus bar 13R. The second choke coil 17 has a winding 17*a* connected to the bus bar 12L and a winding 17*b* connected to the bus bar 13L.

The antennas 14, 14' are located respectively upwardly and downwardly of the heaters 11, 12, 13. The antennas 14, 14' have respective terminals 14*c*, 14'*c* for connection to feeder lines, not shown. The upper antenna 14 is connected to the upper heater 12 through capacitive coupling for drawing electric energy received by the upper heater 12. The lower antenna 14' is connected to the lower heater 13 through capacitive coupling for drawing electric energy received by the lower heater 13.

The middle heater 11 is supplied with about ½ of the sum of the heating currents, and each of the upper and lower heaters 12, 13 are supplied with about ¼ of the sum of the heating currents. Thus, the choke coils 16, 17 can further be reduced in size.

In the first and second embodiments, the defrosting heaters are used as part of the antennas. However, electric energy of AM broadcasts that have been received may be drawn from the defrosting heaters through DC blocking capacitors.

In the first and second embodiments, because the window glass antenna device has a plurality of heaters, the heating currents supplied to the defrosting heaters may be reduced. Accordingly, the choke coils and the bus bars may be connected to each other through thin connector wires and with ease.

Furthermore, the resistances of at least two defrosting heaters are substantially the same as each other, and the choke coils are interposed between the defrosting heaters and the heating power supply for causing currents to flow to the defrosting heaters in directions to cancel the magnetic fluxes in the cores of the choke coils thereby to preventing the cores of the choke coils from being magnetically saturated. Since the diameter of the windings of the choke coils may be reduced as the heating currents are reduced, the choke coils may be reduced in size.

The choke coils are positioned near the opposite ends of the window glass panel for shortening the distances between the bus bars and the choke coils and minimizing any leakage from AM broadcast signals received by the defrosting heaters to the automobile body. As a result, any variations in the reception sensitivity for AM broadcasts can be reduced.

Figure 3:
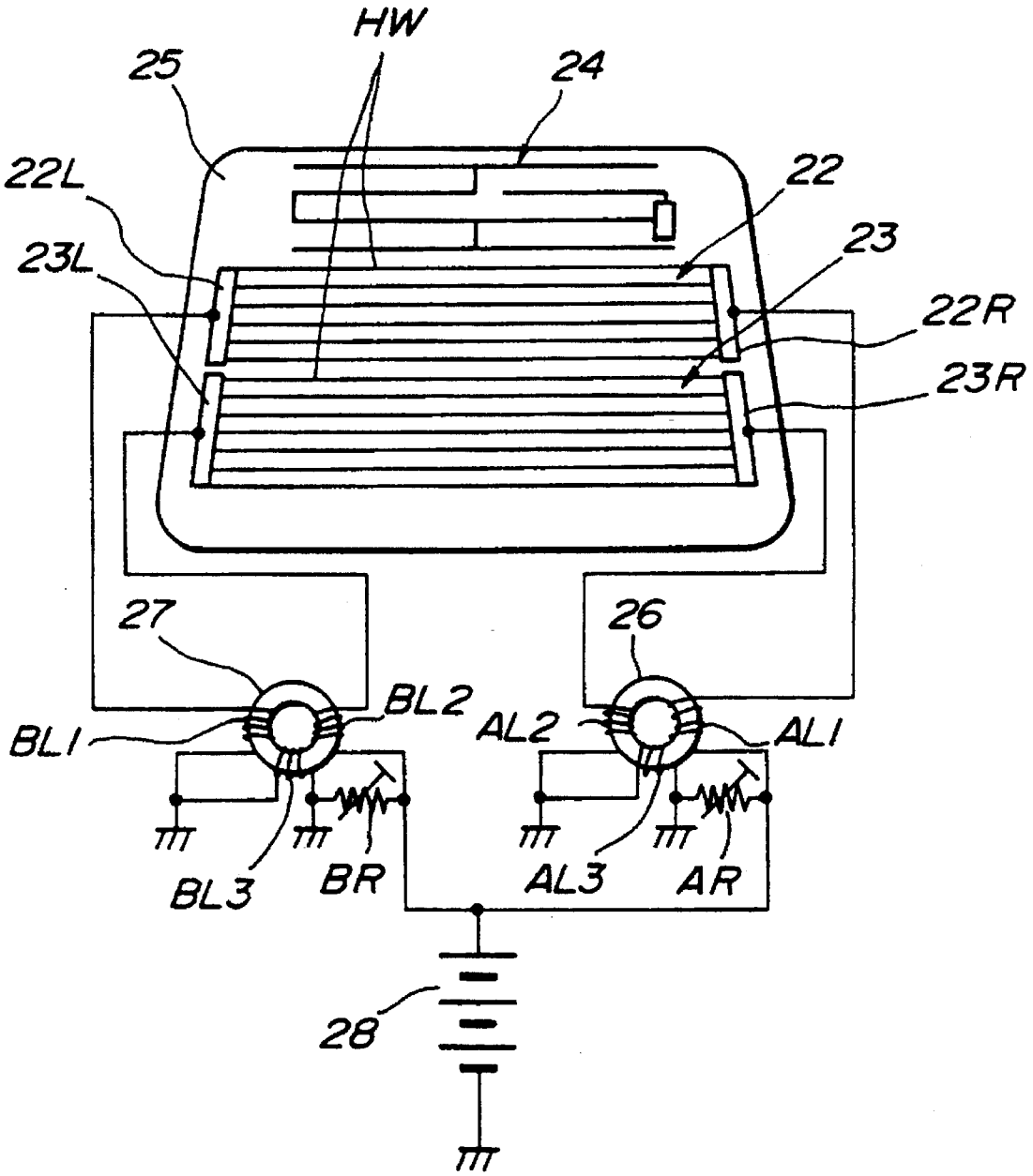
FIG. 3 is a circuit diagram of a window glass antenna device according to a third embodiment of the present invention.

FIG. 3 illustrates a window glass antenna device according to a third embodiment of the present invention.

The window glass antenna device shown in FIG. 3 is of essentially the same arrangement as the window glass antenna device shown in FIG. 1. As shown in FIG. 3, the window glass antenna device comprises a first defrosting heater 22 disposed on a window glass panel 25 of an automobile, a second defrosting heater 23 disposed on the window glass panel 25, and an antenna 24 disposed on the window glass panel 5. The first and second defrosting heaters 22, 23 comprise heater wires HW which have ends interconnected by bus bars 22R, 22L, 23R, 23L. The window glass antenna device also has first and second choke coils 26, 27 connected to the bus bars 22R, 23R, 22L, 23R. The choke coils 26, 27 comprise circular cores, respectively, each with three windings supported thereon. More specifically, the first choke coil 26 comprises a circular core, first, second, and third windings AL1, AL2, AL3 wound around the circular core, and a trimmer resistor AR for adjusting a current supplied to the third winding AL3. Similarly, the second choke coil 27 comprises a circular core, first, second, and third windings BL1, BL2, BL3 wound around the circular core, and a trimmer resistor BR for adjusting a current supplied to the third winding BL3. The third windings AL3, BL3 and the trimmer resistors AR, BR are connected to a positive terminal of a heating power supply 28.

The bus bar 22R, shown on the right-hand side in FIG. 3, connected to one end of the first heater 22 is connected through the first winding AL1 of the choke coil 26 to the positive terminal of the heating power supply 28, and the bus bar 22L, shown on the left-hand side in FIG. 3, connected to the other end of the first heater 22 is connected through the first winding BL1 of the choke coil 27 to the negative terminal of the heating power supply 28, i.e., the automobile body as ground.

The bus bar 23L, shown on the left-hand side in FIG. 3, connected to one end of the second heater 23 is connected through the second winding BL2 of the choke coil 27 to the positive terminal of the heating power supply 28, and the bus bar 23R, shown on the right-hand side in FIG. 3, connected to the other end of the first heater 23 is connected through the second winding AL2 of the choke coil 26 to the negative terminal of the heating power supply 28, i.e., the automobile body as ground.

The third winding AL3 of the choke coil 26 is connected between the automobile body and the positive terminal of the heating power supply 28 through the trimmer resistor AR. The third winding BL3 of the choke coil 27 is connected between the automobile body and the positive terminal of the heating power supply 28 through the trimmer resistor BR.

The windings of the choke coil 26 are arranged such that the magnetic flux which is generated in the core by the current flowing through the first winding AL1 flows in an opposite direction to the magnetic flux which is generated in the core by the current flowing through the second winding AL2. Likewise, the windings of the choke coil 27 are arranged such that the magnetic flux which is generated in the core by the current flowing through the first winding BL1 flows in an opposite direction to the magnetic flux which is generated in the core by the current flowing through the second winding BL2.

In the event that the combined resistances of the first and second heaters 22, 23 are not equal to each other because of differences between the lengths, the materials, the widths, and numbers of the heater wires HW of the first and second heaters 22, 23, the currents flowing through the first and second windings of the choke coils 26, 27 differ from each other, and the magnetic fluxes generated in the cores of the chokes 26, 27 are not canceled due to the different currents. When this happens, suitable adjustments may be made using the third windings AL3, BL3.

For example, the third winding AL3 of the choke coil 26 is supplied with a current of such a magnitude in such a direction that the magnetic fluxes generated by the currents flowing through the first and second windings AL1, AL2, including any difference between the magnetic fluxes, are canceled. The magnitude of the current supplied to the third winding AL3 can be adjusted by the trimmer resistor AR. Similarly, the third winding BL3 of the choke coil 27 is supplied with a current of such a magnitude in such a direction that the magnetic fluxes generated by the currents flowing through the first and second windings BL1, BL2, including any difference between the magnetic fluxes, are canceled. The magnitude of the current supplied to the third winding AL3 can be adjusted by the trimmer resistor BR.

Usually, both the choke coils 26, 27 have their own windings AL3, BL3, respectively. However, if the number of turns of the fist windings BL1 and the number of turns of the second windings BL2 are not the same as each other so as to be able to accommodate, by design, any difference between the resistances of the first and second heaters 22, 23, then the choke coil 27 may be devoid of the third winding BL3, and only the choke coil 26 may have the choke coil 26.

Figure 4:
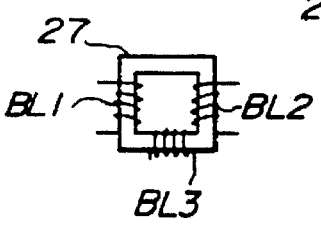
FIGS. 4(*a*), 4(*b*), and 4(*c*) are views showing various structures for the choke coils in the window glass antenna device according to the third embodiment.
Figure 4:
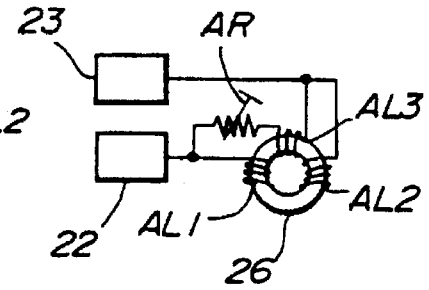
Figure 4:
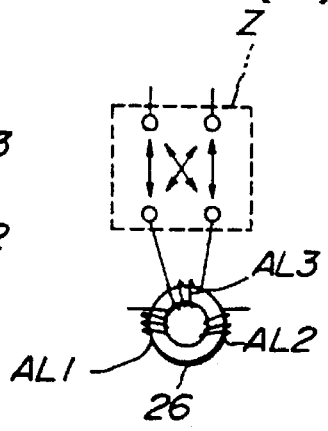

FIGS. 4(*a*), 4(*b*), and 4(*c*) show different choke coil arrangements. FIG. 4(*a*) shows a choke coil 27 having a rectangular core with first, second, and third windings BL1, BL2, BL3 disposed therearound. FIG. 4(*b*) illustrates a choke coil 26 with a third winding AL3 connected to the heaters rather than to the heating power supply. FIG. 4(*c*) shows a choke coil 26 connected to a switching unit Z for adjusting the direction in which a current flows to a third winding AL3.

In FIG. 3, the connector wires by which the bus bars 22R, 23R are connected to the choke coil 26 and the connector wires by which the bus bas 22L, 23L are connected to the choke coil 27 are shown as somewhat long. However, these connector wires are as short as possible in reality.

In the window glass antenna device according to the third embodiment, when the third winding on each of the choke coils is energized through the trimmer resistor or current adjuster, it generates a magnetic flux to cancel the magnetic flux which is generated in the core due to any difference between the currents flowing through the first and second windings. Therefore, even when the components of the window glass antenna device suffer characteristic variations, easy adjustments can be made to prevent the inductance characteristics of the choke coils from being degraded. The heaters can be maintained at a high impedance level for good antenna characteristics.

A window glass antenna device according to a fourth embodiment of the present invention will be described below with reference to FIG. 5.

Figure 5:
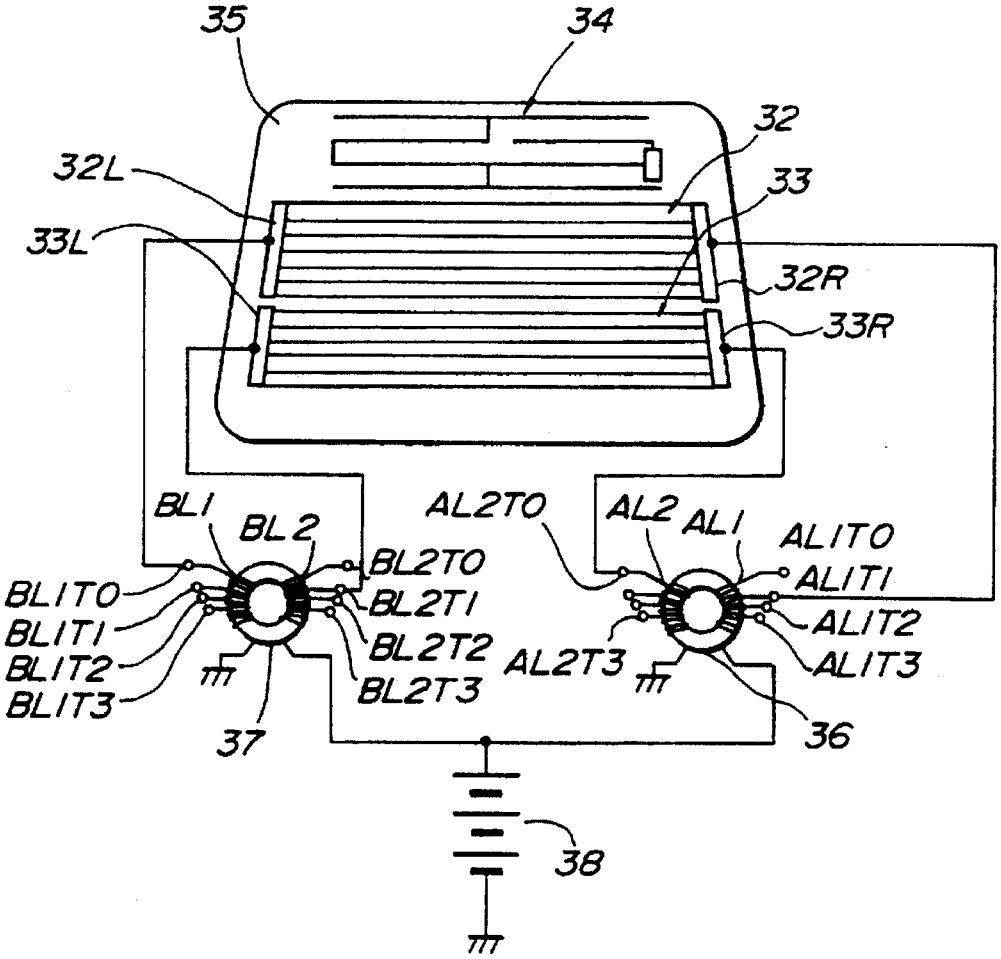
FIG. 5 is a circuit diagram of a window glass antenna device according to a fourth embodiment of the present invention.

The window glass antenna device shown in FIG. 5 comprises a first defrosting heater 32 disposed on a window glass panel 35 of an automobile, a second defrosting heater 33 disposed on the window glass panel 25, an antenna 34 disposed on the window glass panel 5, choke coils 36, 37, and a heating power supply 38. The first and second defrosting heaters 32, 33 comprise heater wires HW which have ends interconnected by bus bars 32R, 32L, 33R, 33L. More specifically, the first defrosting heater 32 comprises seven heater wires HW, and the second defrosting heater 33 comprises six heater wires HW. The choke coil 36 comprises a tapped choke coil having a circular core, a first winding AL1 wound around the circular core and having taps AL1T0~AL1T3, and a second winding AL2 wound around the circular core and having taps AL2T0~AL2T3. The choke coil 37 comprises a tapped choke coil having a circular core, a first winding BL1 wound around the circular core and having taps BL1T0~BL1T3, and a second winding BL2 wound around the circular core and having taps BL2T0~BL2T3.

The bus bar 32R, shown on the right hand side in FIG. 5, connected to one end of the first heater 32 is connected through one of the taps AL1T0~AL1T3 of the first winding AL1 of the tapped choke coil 36 to the positive terminal of the heating power supply 38, and the bus bar 32L shown on the left hand side in FIG. 5, connected to the other end of the first heater 32 is connected through one of the taps BL1T0~BL1T3 of the first winding BL1 of the tapped choke coil 37 to the negative terminal of the heating power supply 28, i.e., the automobile body as ground.

The bus bar 33L, shown on the left-hand side in FIG. 5, connected to one end of the second heater 33 is connected through one of the taps BL2T0~BL2T3 of the second winding BL2 of the tapped choke coil 37 to the positive terminal of the heating power supply 38, and the bus bar 33R, shown on the right-hand side in FIG. 5, connected to the other end of the second heater 33 is connected through one of the taps AL2T0~AL2T3 of the second winding AL2 of the tapped choke coil 36 to the negative terminal of the heating power supply 38, i.e., the automobile body as ground.

As shown in FIG. 5, since the number of heater wires HW of the first heater 32 is different from the number of heater wires HW of the second heater 33, in order to cancel the magnetic fluxes generated in the cores of the choke coils 36, 37, it is necessary that the number of turns of the first and second windings of the tapped choke coils 36, 37 be adjusted. Each of the windings of the tapped choke coils 36, 37 may have a desired number of taps depending on the number of turns thereof. Thus, the magnetic fluxes generated in the cores of the choke coils 36, 37 can be canceled by selecting suitable taps thereby to adjust the number of turns of the windings thereof. Stated otherwise, at least one of the two windings on the core of each of the choke coils 36, 37 has a plurality of taps that may be selected to provide a number of winding turns for canceling the magnetic fluxes that are generated in the core by the currents flowing through the first and second heaters 32, 33.

Figure 6:
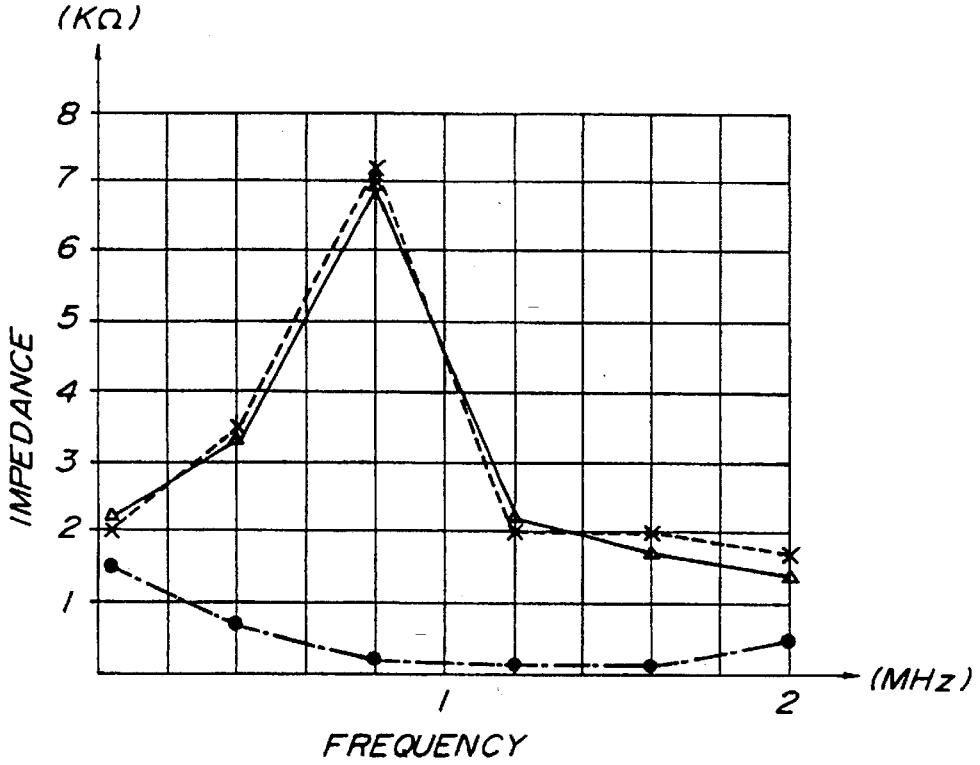
FIG. 6(*a*)is a graph showing impedance vs. frequency characteristics of tapped choke coils at various settings.
Figure 7:
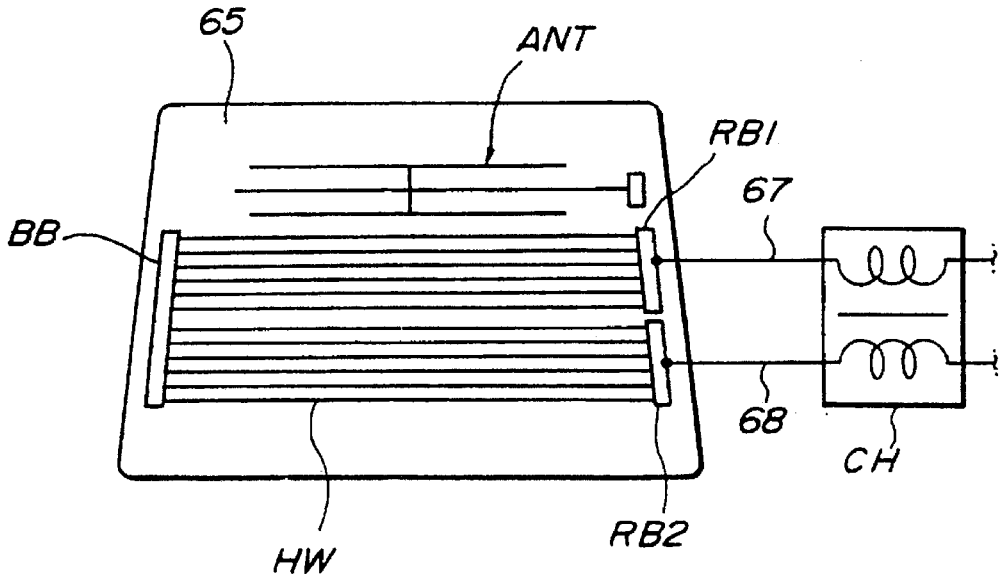
FIG. 7 (a) PRIOR ART
FIG. 7 (*a*) is a circuit diagram of a conventional window glass antenna device of a single-sided feeding structure.
Figure 7:
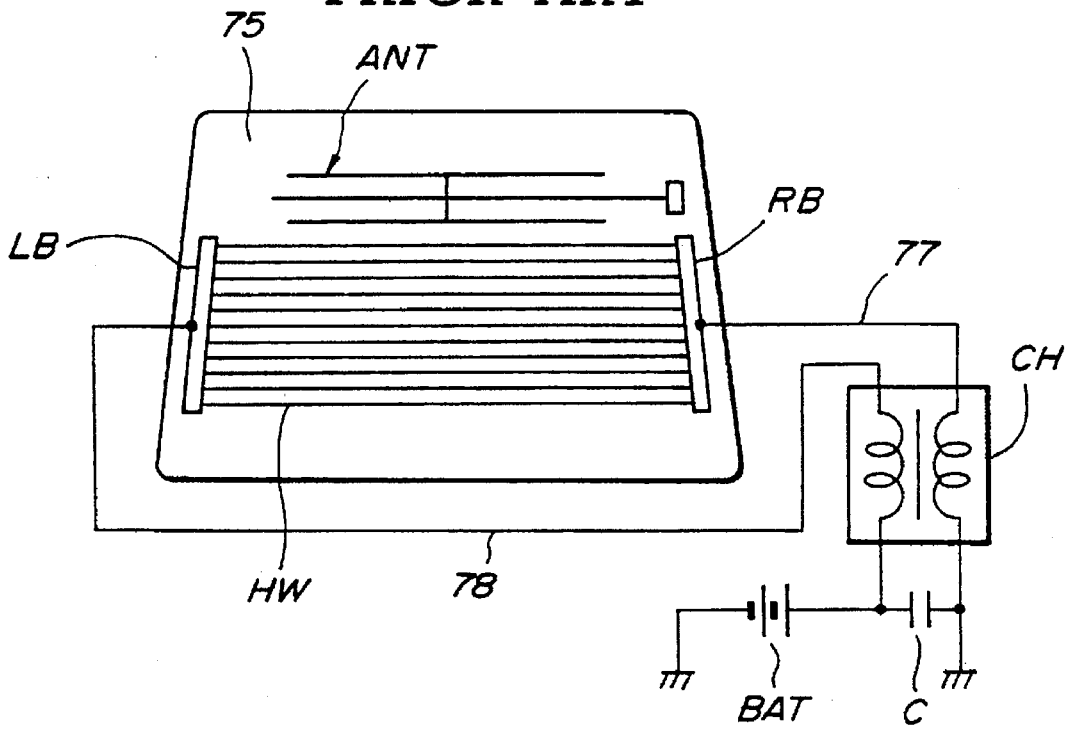
FIG. 7 (b) PRIOR ART
Figure 8:
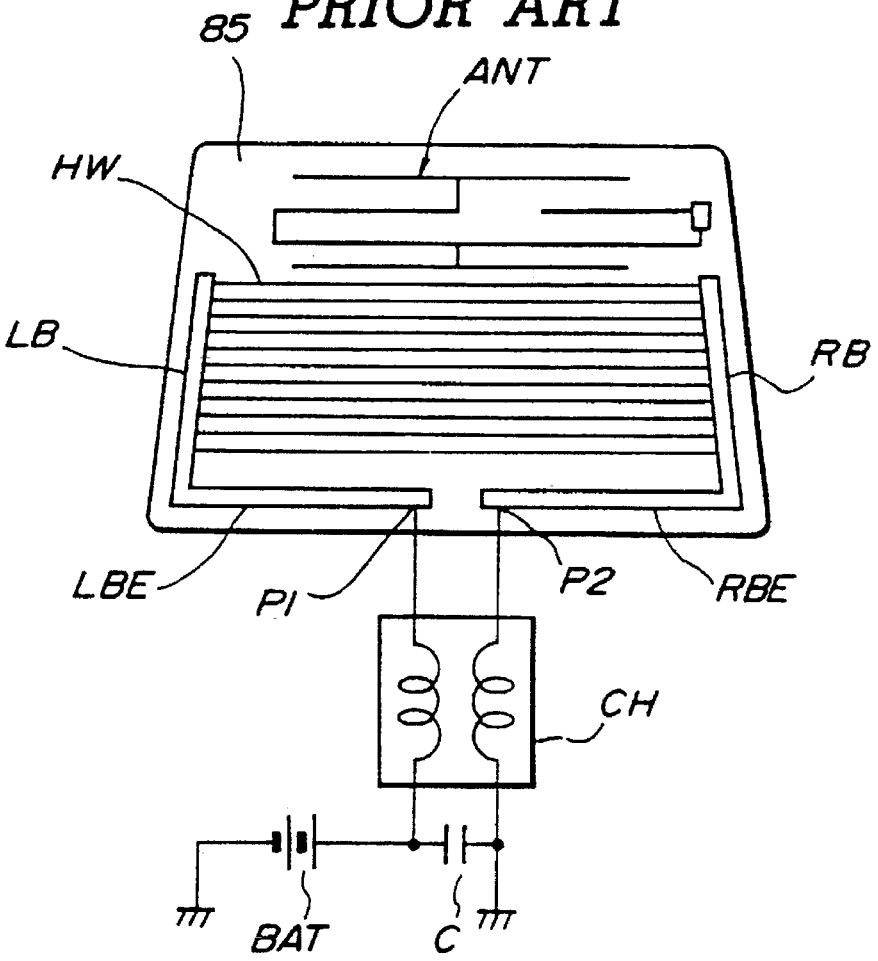
FIG. 8 PRIOR ART
FIG. 8 is a circuit diagram of another conventional window glass antenna device of a double-sided feeding structure.
Figure 9:
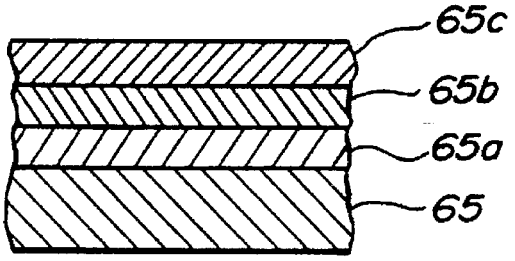
FIG. 9 PRIOR ART
FIG. 9 is an enlarged cross-sectional view of a heater on the conventional window glass antenna device of a single-sided feeding structure.
Figure 10:
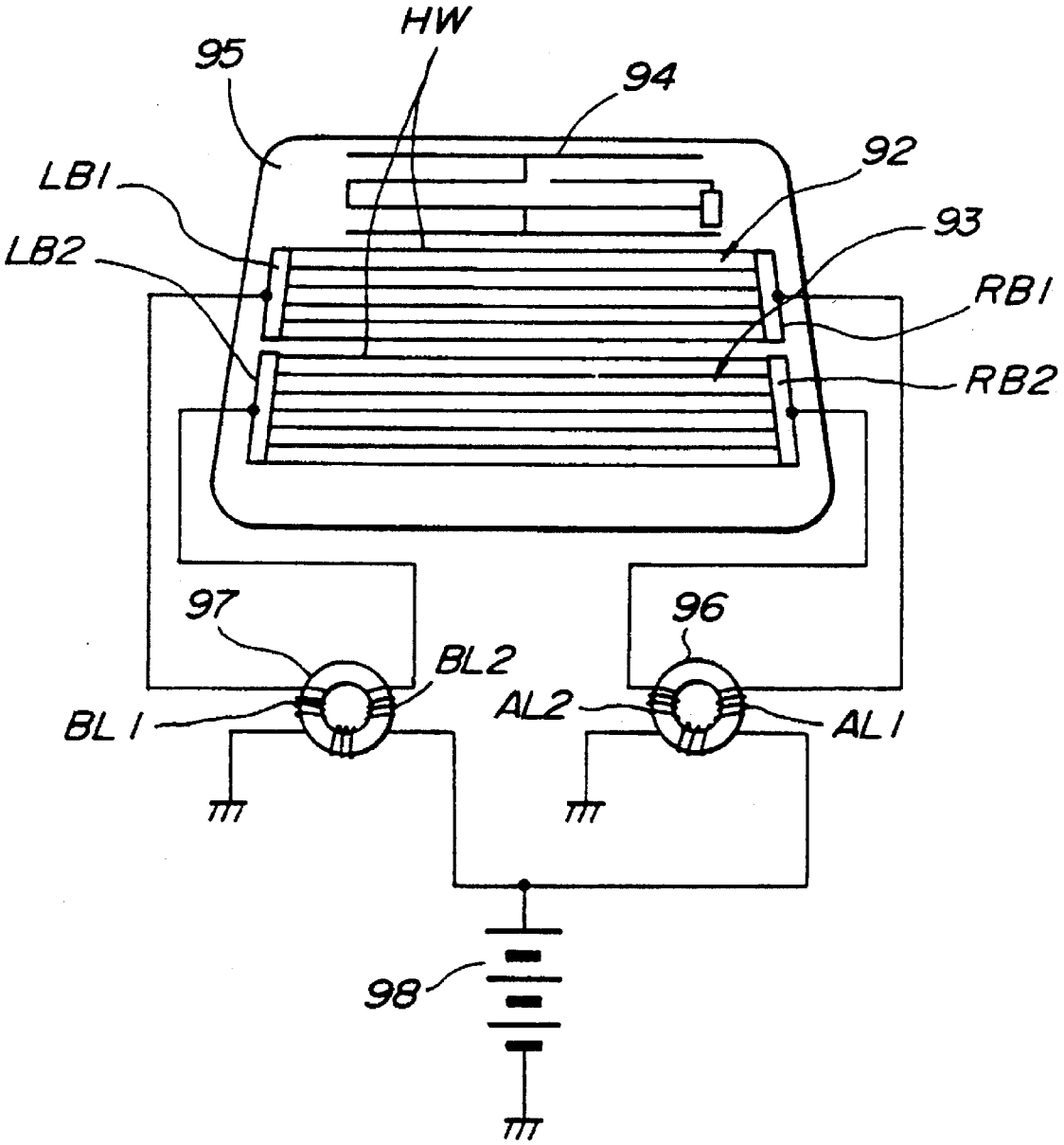
FIG. 10 PRIOR ART
FIG. 10 is a circuit diagram of still another conventional window glass antenna device of a double-sided feeding structure.
Figure 11:
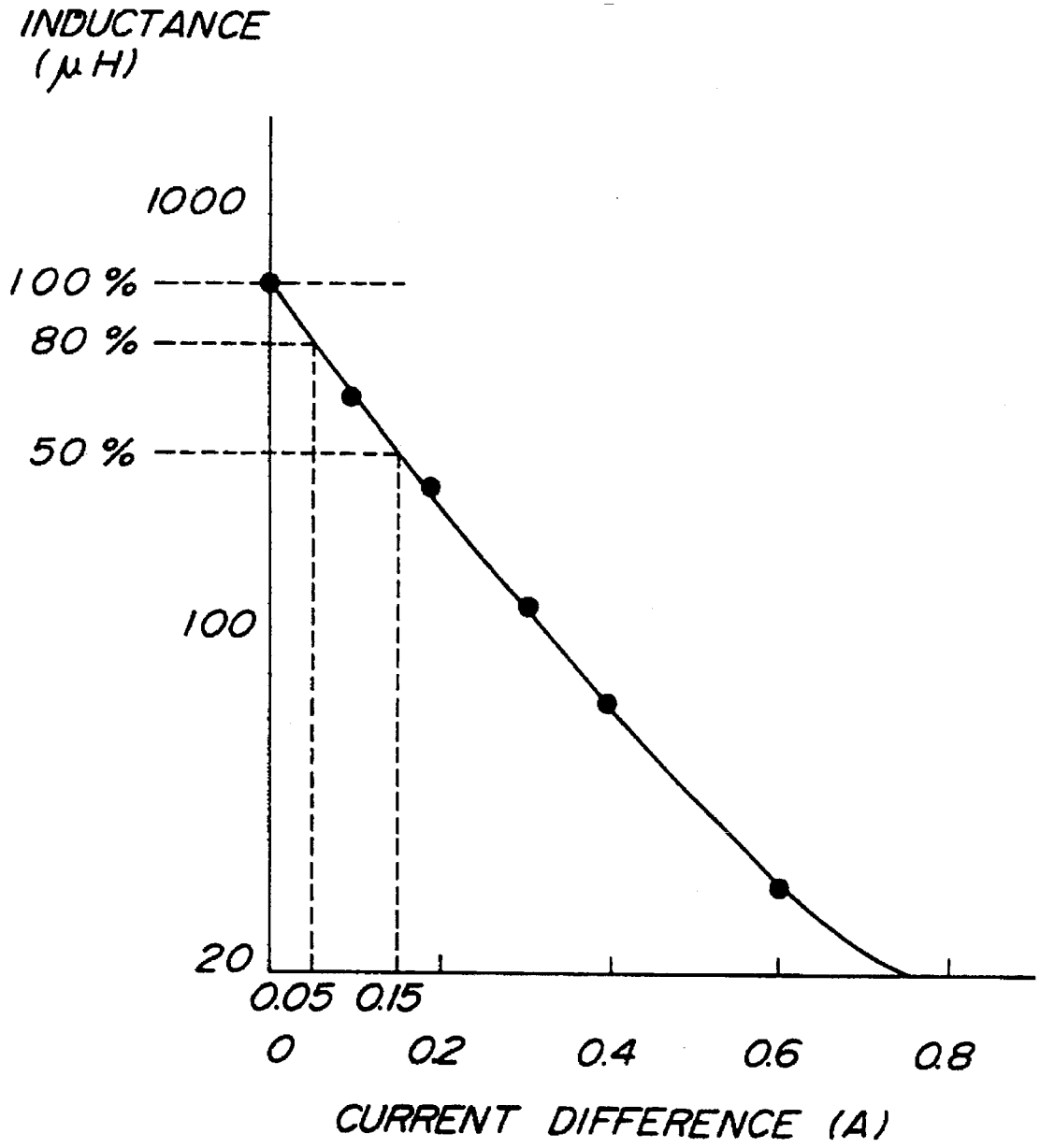
FIG. 11 PRIOR ART
FIG. 11 is a graph showing inductance vs. current difference characteristics of a choke coil in the conventional window glass antenna device shown in FIG. 10.

FIG. 6(*a*) shows impedance values of the tapped choke coil 26 that are plotted at various frequencies with different settings as shown in FIG. 6(*b*). For example, if each of the first and second heaters 32, 33 has six heater wires HW, then the impedance of the tapped choke coil 36 is high in the vicinity of a frequency of 1 MHz when the first winding AL1 has 13 turns, i.e., the tap AL1T1 is selected, and the second winding AL2 has 13 turns, i.e., the tap AL2T1 is selected.

If the first heater 32 has seven heater wires HW with the same taps selected, then an unbalanced current is produced, causing the core, e.g., a ferrite core, to be magnetically saturated. As a result, the impedance of the tapped choke coil 36 is greatly reduced, degrading antenna characteristics of the heaters.

If the tap AL2T0 of the second winding AL2 is selected to achieve 15 winding turns, then the impedance of the tapped choke coil 36 is high. Since an unbalanced current can be avoided by varying the number of turns of the windings of the choke coils, the heaters may be kept at a high impedance level, and may operate highly efficiently as an antenna.

Only either one of the first and second windings of each choke coil may be provided with selectable taps.

In the window glass antenna device according to the fourth embodiment, some of the taps of the windings of the choke coils are selected and the choke coils are energized through the selected taps to cancel the magnetic fluxes that are generated in the cores of the choke coils. Therefore, the magnetic fluxes that are generated in the cores of the choke coils can be canceled even when the currents flowing through the first and second windings of the choke coils differ from each other. Consequently, even when the components of the winding glass antenna device suffer characteristic variations, easy adjustments can be made to prevent the inductance characteristics of the choke coils from being degraded. The heaters can be maintained at a high impedance level for good antenna characteristics.

Although there have been described what are at present considered to be the preferred embodiments of the invention, it will be understood that the invention may be embodied in other specific forms without departing from the essential characteristics thereof. The present embodiments are therefore to be considered in all respects as illustrative, and not restrictive. The scope of the invention is indicated by the appended claims rather than by the foregoing description.

What is claimed is:

1. A window glass antenna device comprising:

a window glass panel;

defrosting heaters for use as part of a reception antenna, said defrosting heaters including at least first and second heaters each comprising a plurality of heater wires disposed on said window glass panel, first bus bars interconnecting ends of said heater wires, and second bus bars interconnecting opposite ends of said heater wires;

current supply means for supplying electric currents to said defrosting heaters;

a first choke coil connected between the first bus bars of said first and second heaters and said current supply means; and a second choke coil connected between the second bus bars of said first and second heaters and said current supply means;

said first choke coil having a core and at least two windings disposed around said core, said windings being connected respectively to the first bus bars of said first and second heaters such that magnetic fluxes generated in said core by a first electric current flowing through said first heater and a second electric current flowing through said second heater will be canceled;

said second choke coil having a core and at least two windings disposed around said core, said windings being connected respectively to the second bus bars of said first and second heaters such that magnetic fluxes generated in said core by said first electric current flowing through said first heater and said second electric current flowing through said second heater will be canceled; and at least one of said first and second choke coils including a third winding disposed around said core, and current adjusting means for supplying an electric current from said current supply means to said third winding for producing a magnetic flux to cancel any magnetic flux produced by the difference between electric currents flowing through said two windings of said at least one of said first and second choke coil.

2. A window glass antenna device according to claim 1, wherein said first heater has a first combined resistance and said second heater has a second combined resistance, said first combined resistance being equal to said second combined resistance.

3. A window glass antenna device according to claim 2, wherein said first heater is above said second heater, said first and second heaters including an uppermost and lowermost heater wire, said heater wires of said first heater extend substantially parallel to each other, and said heater wires of said second heater extend substantially parallel to each other, said first and second heaters being trapezoidal in shape with said uppermost heater wire of said first heater defining an upper side, and said lowermost heater wire of the second heater defining a lower side, and the bus bars defining right and left sides.

4. A window glass antenna device according to claim 3, wherein the number of the heater wires of said first heater is different from the number of the heater wires of said second heater in order to equalize said first combined resistance to said second combined resistance.

5. A window glass antenna device according to claim 3, wherein the width of the heater wires of said first heater and the width of the heater wires of said second heater are adjusted in order to equalize said first combined resistance to said second combined resistance.

6. A window glass antenna device according to claim 1, further comprising an antenna disposed in capacitive coupling with one of said first and second heaters.

7. A window glass antenna device according to claim 6, wherein said defrosting heaters further include a third heater disposed between said first and second heaters, said antenna including first and second patterns disposed in independent capacitive coupling with said first and second heaters, respectively.

8. A window glass antenna device comprising:

a window glass panel;

defrosting heaters for use as part of a reception antenna, said defrosting heaters including at least first and second heaters each comprising a plurality of heater wires disposed on said window glass panel, first bus bars interconnecting ends of said heater wires, and second bus bars interconnecting opposite ends of said heater wires;

current supply means for supplying electric currents to said defrosting heaters;

a first choke coil connected between the first bus bars of said first and second heaters and said current supply means; and a second choke coil connected between the second bus bars of said first and second heaters and said current supply means;

said first choke coil having a core at least two windings disposed around said core, said windings being connected respectively to the first bus bars of said first and second heaters such that magnetic fluxes generated in said core by a first electric current flowing through said first heater and a second electric current flowing through said second heater will be canceled;

said second choke coil having a core and at least two windings disposed around said core, said windings being connected respectively to the second bus bars of said first and second heaters such that magnetic fluxes generated in said core by said first electric current flowing through said first heater and said second electric current flowing through said second heater will be canceled; and at least one of said two windings of each of said first and second choke coils including a plurality of taps selectable to provide a number of winding turns for canceling the magnetic fluxes generated in said core by said first electric current flowing through said first heater and said second electric current flowing through said second heater.

9. A window glass antenna device having first and second defrosting heaters disposed independently of each other on an automobile window glass panel, first and second choke coils independent of each other and each having a core and first and second windings disposed independently of each other on said core, and a heating power supply for supplying electric currents to said first and second defrosting heaters, said first windings of said first and second choke coils being connected between one and other ends of said first defrosting heater and said heating power supply, said second windings of said first and second choke coils being connected between one and other ends of said second defrosting heater, which are positioned on the same side of said one and other end of said first defrosting heater, and said heating power supply, said first and second defrosting heaters being used as part of a reception antenna, characterized in that at least one of said first second choke coils has a third winding disposed around said core, and current adjusting means for supplying an electric current from said heating power supply to said third winding for producing a magnetic flux to cancel any magnetic flux produced in said core by the difference between electric currents flowing through said first and second windings.

10. A window glass antenna device according to claim 9, wherein at least one of said first and second choke coils has a plurality of taps on at least one of said first and second windings to provide corresponding numbers of winding turns, said taps being selectable for connection to said heating power supply to supply electric currents from said heating power supply to cancel magnetic fluxes generated in said core by said first and second windings.

* * * * *